US010714073B1

(12) United States Patent
Rui et al.

(10) Patent No.: US 10,714,073 B1
(45) Date of Patent: Jul. 14, 2020

(54) WIND NOISE SUPPRESSION FOR ACTIVE NOISE CANCELLING SYSTEMS AND METHODS

(71) Applicant: SYNAPTICS INCORPORATED, San Jose, CA (US)

(72) Inventors: Liyang Rui, Irvine, CA (US); Govind Kannan, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/399,980

(22) Filed: Apr. 30, 2019

(51) Int. Cl.
*G10K 11/178* (2006.01)
*H04R 1/10* (2006.01)

(52) U.S. Cl.
CPC .. *G10K 11/17881* (2018.01); *G10K 11/17813* (2018.01); *H04R 1/1083* (2013.01); *G10K 2210/1081* (2013.01); *G10K 2210/3026* (2013.01); *G10K 2210/3027* (2013.01); *G10K 2210/3056* (2013.01); *H04R 2460/01* (2013.01)

(58) Field of Classification Search
None
See application file for complete search history.

(56) References Cited

U.S. PATENT DOCUMENTS

2008/0112569 A1* 5/2008 Asada ..... G10K 11/178 381/71.1
2012/0316872 A1* 12/2012 Stoltz ..... G10L 21/0216 704/233
2013/0243214 A1* 9/2013 Penketh ..... G10K 11/175 381/71.6
2014/0072134 A1* 3/2014 Po ..... G10K 11/178 381/71.11
2015/0003625 A1* 1/2015 Uhle ..... H04R 3/002 381/71.6
2016/0180830 A1* 6/2016 Lu ..... H04R 1/1083 381/71.6
2016/0300563 A1* 10/2016 Park ..... G10K 11/17853
2017/0125006 A1* 5/2017 Dzhigan ..... G10K 11/17881
2017/0133000 A1* 5/2017 Hendrix ..... H04R 1/1083
2017/0148428 A1* 5/2017 Thuy ..... G10L 25/78
2019/0069074 A1* 2/2019 Yamkovoy ..... H04R 1/1083

* cited by examiner

*Primary Examiner* — Paul W Huber
(74) *Attorney, Agent, or Firm* — Haynes and Boone, LLP

(57) ABSTRACT

Active noise cancellation (ANC) systems and methods include a reference sensor to sense external noise and generate a reference signal, an error sensor to sense noise in a noise cancellation zone and generate an error signal, a feedforward ANC subsystem to receive the reference and error signals and generate a first anti-noise signal to cancel external noise in a noise cancellation zone, a feedback ANC subsystem to receive the error signal and generate a second anti-noise signal to cancel the external noise in the cancellation zone, a wind detector to detect whether wind noise is present in the reference signal and output a wind noise detection status, and wind handler to control adaptation processing of the feedforward ANC subsystem and the feedback ANC subsystem in accordance with the wind noise detection status and mixing of the first and second anti-noise signals to generate an output anti-noise signal.

20 Claims, 4 Drawing Sheets

WIND NOISE SUPPRESSION FOR ACTIVE NOISE CANCELLING SYSTEMS AND METHODS

TECHNICAL FIELD

The present application relates generally to noise cancelling systems and methods, and more specifically, for example, to adaptive cancelling and/or suppression of wind noise in headphones (e.g., circum-aural, supra-aural and in-ear types), earbuds, hearing aids, and other personal listening devices.

BACKGROUND

Active noise cancellation (ANC) systems commonly operate by sensing ambient noise through a reference microphone and generating a corresponding anti-noise signal that is approximately equal in magnitude, but opposite in phase, to the sensed ambient noise. The ambient noise and the anti-noise signal cancel each other acoustically, allowing the user to hear only a desired audio signal. To achieve this effect, a low-latency, programmable filter path from the reference microphone to a loud-speaker that outputs the anti-noise signal may be implemented. In operation, conventional anti-noise filtering systems do not completely cancel all noise, leaving residual noise and/or generating audible artefacts that may be distracting to the user.

Unlike ambient noise, wind noise occurs at the reference microphone due to local air turbulence and is not correlated to the ambient noise that reaches the ear canal. Wind noise degrades ANC performance in at least two respects. First, wind noise typically passes through the adaptive filter and will be audible to the user. Second, the presence of wind noise can result in an incorrect reference signal, anti-noise signal and/or incorrect adaption of the ANC filter.

In view of the foregoing, there is a continued need for improved active noise cancellation systems and methods for headphones, earbuds and other personal listening devices that may operate in windy environments.

SUMMARY

Systems and methods are disclosed for active noise cancellation in audio listening devices that may be used in windy environments. In one or more embodiments, an active noise cancellation system includes a reference sensor configured to sense environmental noise and generate a corresponding reference signal, an error sensor configured to sense noise in a noise cancellation zone and generate a corresponding error signal, a noise cancellation filter configured to receive the reference signal and the error signal and generate an anti-noise signal to cancel the environmental noise in the cancellation zone, an adaptation module configured to receive the reference signal and the error signal and adaptively adjust the anti-noise signal, and a wind noise detection module configured to receive the reference signal, detect a wind noise event and selectively enable and disable adaptation modules in response to the wind noise event information. In some embodiments, the active noise cancellation system includes a wind detector module configured to detect the presence of wind noise in the reference signal, and a wind handler module configured to adjust a signal gain and/or adaptation parameter to suppress the detected wind noise.

In various embodiments, an active noise cancellation system includes a reference sensor configured to generate a reference signal from external noise and an error sensor configured to generate an error signal from noise sensed in a noise cancellation zone. A feedforward noise cancellation subsystem is configured to generate a first anti-noise signal using the reference signal and the error signal, and a feedback noise cancellation subsystem is configured to generate a second anti-noise signal using the error signal. A wind detection module is configured to determine whether wind noise is present in the reference signal, and output a wind detection status, and a wind handler module is configured to control the feedforward noise cancellation subsystem and the feedback noise cancellation subsystem in accordance with the wind detection status and to generate an output anti-noise signal using the first anti-noise signal and the second anti-noise signal.

The active noise cancellation system may further include a first variable gain module configured to adjust a first gain of the first anti-noise signal, and a second variable gain module configured to adjust a second gain of the second anti-noise signal. The wind handler module is configured to set the first gain and the second gain in response to the wind detection status. The output anti-noise signal may include a first gain adjusted first anti-noise signal and a second gain adjusted second anti-noise signal. The wind handler may be further configured to transition between feedback adaptive noise cancellation and feedforward adaptive noise cancellation in response to a change in the wind noise detection status. In some embodiments, the wind handler module is configured to disable adaptive feedforward noise cancellation in response to detected wind noise, and to disable adaptive feedback noise cancellation if wind noise is not detected.

The active noise cancellation system may include a processor and a memory storing program instructions for execution by the processor, and the wind handler module may comprise program instructions stored in the memory. The active noise cancellation system of may further include an adder configured to combine the first anti-noise signal and the second anti-noise signal to generate the output anti-noise signal. In various embodiments, the active noise cancellation system may be implemented in an active noise cancelling headphone, earbud, hearing aid or other device.

In various embodiments, a method for suppressing wind noise in an active noise cancelling system includes generating a reference signal from external noise, generating an error signal from noise sensed in a noise cancellation zone, generating, using a feedforward noise cancellation process, a first anti-noise signal using the reference signal and the error signal, and generating, using a feedback noise cancellation process, a second anti-noise signal using the error signal. The method further includes determining whether wind noise is present in the reference signal and setting a corresponding wind noise detection status and controlling adaptation processing in the feedforward noise cancellation process and the feedback noise cancellation process in accordance with the wind noise detection status and mixing of the first anti-noise signal and the second anti-noise signal to generate an output anti-noise signal.

The method may further include adjusting a first gain of the first anti-noise signal and/or a second gain of the second anti-noise signal in response to the wind noise detection status, and after adjusting the first gain of the first anti-noise signal and/or the second gain of the second anti-noise signal, generating the output anti-noise signal by combining the first anti-noise signal and the second anti-noise signal. The method may further comprise detecting changes in the wind noise detection status and transitioning between a feedback adaptive noise cancellation process and a feedforward adaptive noise cancellation process, disabling adaptive feedforward noise cancellation if wind noise is detected, and/or disabling adaptive feedback noise cancellation if wind noise is absent.

In some embodiments, the controlling adaptation processing of the feedforward noise cancellation process is performed by a wind handler module of a digital signal processor. The method may further comprise combining the first anti-noise signal and the second anti-noise signal to generate the output anti-noise signal.

The scope of the invention is defined by the claims, which are incorporated into this section by reference. A more complete understanding of embodiments of the disclosure will be afforded to those skilled in the art, as well as a realization of additional advantages thereof, by a consideration of the following detailed description. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

In accordance with various embodiments, improved active noise cancellation (ANC) systems and methods for cancelling and/or suppressing ambient noise and wind noise are disclosed. A headphone or other personal listening device may include an active noise cancellation (ANC) system to attenuate ambient noise. In a general arrangement, an ANC system includes a reference sensor (e.g., a microphone or other audio sensor), an adaptive filter, and an error sensor (e.g., a microphone or other audio sensor). The reference sensor senses the ambient noise and generates a corresponding reference audio signal. The adaptive filter generates an anti-noise signal from the reference audio signal and an error signal and passes it to a loudspeaker or other transducer to offset the ambient sound at the listener's ear. The error sensor monitors residual sound, providing feedback on the performance of the adaptive filter. The ANC system continually evaluates the reference audio signal and the error signal and adaptively corrects the adaptive filter to achieve better ambient noise attenuation effect.

Unlike ambient noise, wind noise occurs at the reference sensor due to local air turbulence. This wind noise is not correlated to the ambient noise that is heard by the listener and degrades ANC performance in at least two respects. First, wind noise may pass through the adaptive filter and be audible to the user. Second, wind noise may produce incorrect anti-noise and the ANC filter may adapt incorrectly. In various embodiments, a wind detector and a wind event handler are provided to cancel and/or suppress undesirable wind noise. When wind noise is absent, the wind event handler configures the ANC to use both the reference signal and error signal in a feedforward arrangement to adaptively filter the reference signals and generate anti-noise. When wind noise is detected, the wind event handler configures the ANC to use the error signal in a feedback arrangement to adaptively filter the error signal and generate the anti-noise (without using the reference signal).

Figure 1:
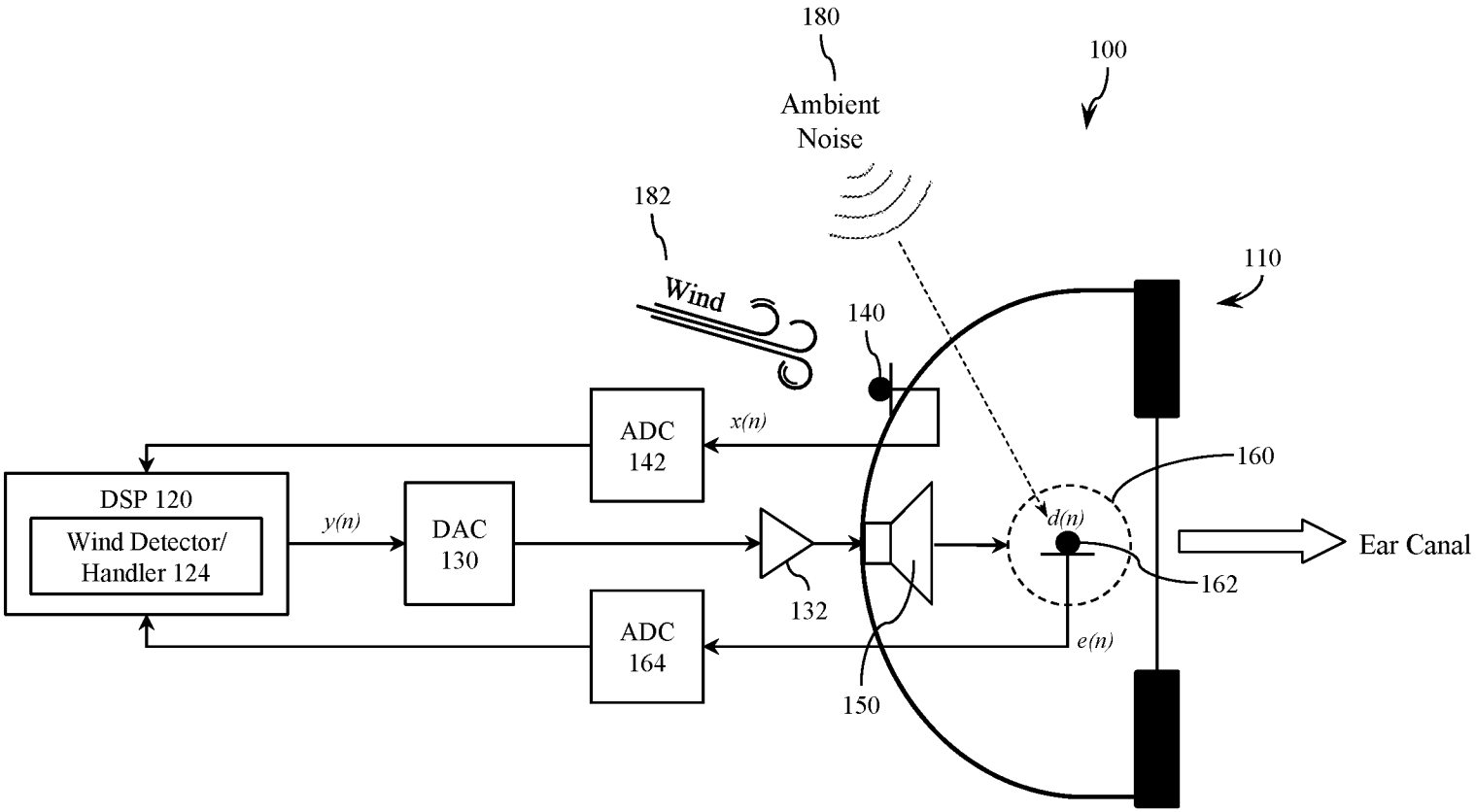
FIG. 1 illustrates an active noise cancellation headset providing wind noise cancellation and/or suppression, in accordance with one or more embodiments of the present disclosure.

Example embodiments of adaptive noise cancelling systems for wind noise suppression will now be described with reference to the figures. FIG. 1 illustrates an active noise cancellation headset providing wind noise cancellation and/or suppression, in accordance with one or more embodiments of the present disclosure. An active noise cancelling (ANC) system 100 includes an audio device, such as headphone 110, and audio processing circuitry, such as digital signal processor (DSP) 120, a digital to analog converter (DAC) 130, an amplifier 132, a reference microphone 140, a loudspeaker 150, an error microphone 162, and other components.

In operation, a listener may hear external noise d(n) through the housing and components of the headphone 110. To cancel the noise d(n), the reference microphone 140 senses the external noise (such as ambient noise 180), producing a reference signal x(n) which is fed through an analog-to-digital converter (ADC) 142 to the DSP 120. The DSP 120 generates an anti-noise signal y(n), which is fed through the DAC 130 and the amplifier 132 to the loudspeaker 150 to generate anti-noise in a noise cancellation zone 160. The DSP 120 is configured to cancel and/or suppress the noise d(n) in the noise cancellation zone 160 by generating anti-noise that is equal in magnitude and opposite in phase to the noise d(n) in the noise cancellation zone 160. The resulting mixture of noise and anti-noise is captured by the error microphone 162 which generates an error signal e(n) to measure the effectiveness of the noise cancellation. The error signal e(n) is fed through ADC 164 to the DSP 120, which adjusts the magnitude and phase of the anti-noise signal y(n) to minimize the error signal e(n) within the cancellation zone 160 (e.g., drive the error signal e(n) to zero).

In some embodiments, the loudspeaker 150 may also generate desired audio (e.g., music) which is received by the error microphone 162 and removed from the error signal e(n) during processing by the DSP 120 (or other audio components). It will be appreciated that the embodiment of FIG. 1 is one example of an active noise cancellation system and that the systems and methods disclosed herein may be implemented with other adaptive noise cancelling implementations that include a reference microphone and an error microphone.

The reference microphone 140 may also generate audio signals associated with wind noise, such as audio signals generated from wind 182 which may hit the reference microphone 140. In some implementations, the wind noise may pass through standard ANC processing of the DSP 120 and be played for the listener. In some implementations, the standard ANC processing of the DSP 120 may produce an anti-noise signal to cancel or suppress all or a portion of the wind noise. However, the wind noise picked up by the reference microphone 140 may not correlate to ambient noise 180 received at the error microphone 162 and/or the listener's ear canal, resulting in anti-noise artefacts that negatively impact the listening experience.

To cancel and/or suppress wind noise, the DSP 120 includes wind detector and wind handler components 124 configured to detect wind noise generated by the reference microphone 140 and manage processing to suppress the detected wind noise. The DSP 120 may comprise one or more of a processor, a microprocessor, a programmable logic device, a digital signal processor or other logic device. The wind detector and wind handler components 124, and other ANC components and processes disclosed herein, may comprise software instructions stored in a memory for execution by the DSP 120.

In various embodiments, the DSP 120 is configured to process anti-noise signals through a feedforward ANC (FFANC) subsystem and a feedback ANC (FBANC) subsystem. The FFANC subsystem is configured to analyze both the reference signal x(n) and the error microphone signal e(n) to produce the anti-noise signal for noise cancellation. The FFANC subsystem is activated by the wind detector and wind handler components 124 when wind noise is absent (e.g., when wind noise has not been detected). The FBANC subsystem predicts an anti-noise signal based on the error signal e(n) (e.g., the anti-noise signal may be based on the error signal e(n) without using the reference signal x(n)) and is configured to suppress the detected wind noise. The FBANC subsystem is activated by the wind detection and wind handler components 124 when wind noise is present (e.g., when wind noise has been detected).

Figure 2:
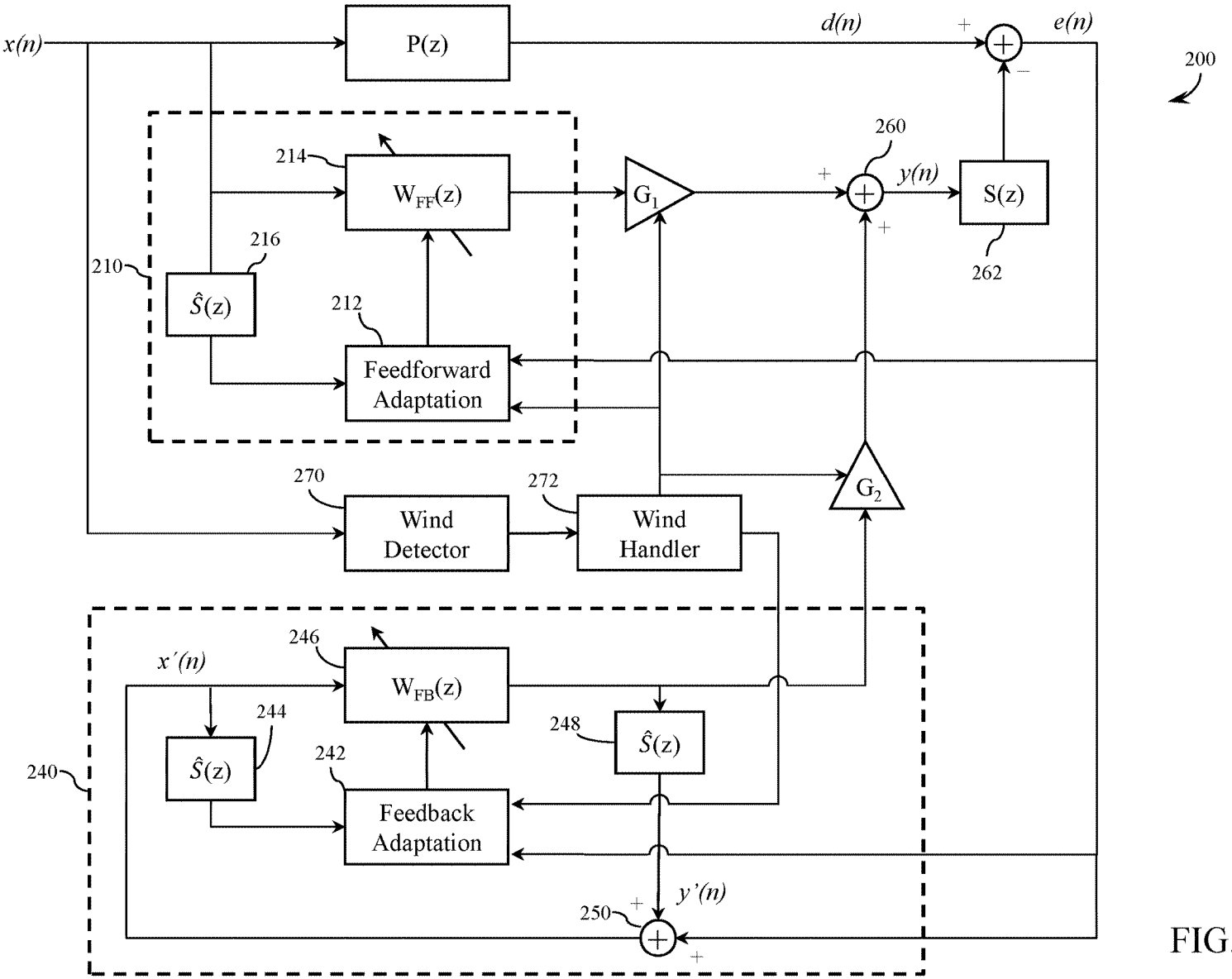
FIG. 2 illustrates an active noise cancellation system including components providing wind noise detection and handling, in accordance with one or more embodiments of the present disclosure.

FIG. 2 illustrates an example active noise cancelling (ANC) system 200 that includes improved wind noise cancellation performance, substantially free of undesirable audio artefacts when compared to conventional systems. The ANC system 200 senses ambient noise at an external reference microphone (e.g., microphone 140 of FIG. 1) which produces a reference signal, x(n). The ambient noise also passes through a noise path P(z), including the housing and components of the listening device, and is received as d(n) at an error microphone (e.g., error microphone 162).

The ANC system 200 includes a feedforward ANC subsystem 210 and a feedback ANC subsystem 240 for generating an anti-noise signal to cancel d(n). The feedforward ANC subsystem 210 may be implemented as a filtered-X Least Mean Square (FxLMS) adaptive filter, or another adaptive feedforward approach. The feedforward ANC subsystem 210 adaptively generates an anti-noise signal y (n) from the reference signal x(n) through a digital filter 214. The anti-noise signal is output through a loudspeaker and received at the error microphone through a secondary path S(n) 262, which includes the path from the filter 214 through the loudspeaker to the error microphone.

The feedforward adaptation module 212 (e.g., a LMS adaptive filter) updates the weights $W_{FF}(z)$ (e.g., a set of filter coefficients for the digital filter 214 in the feedforward path) based on the error signal e(n) measured by the error microphone and the reference signal x(n). In the illustrated embodiment, the reference signal x(n) is filtered with a model of the secondary path 216 ($\hat{S}(z)$), which aligns the phases of the reference signal x(n) and error signal e(n). The feedforward adaptation module 212 then adaptively adjusts the filter coefficients/weights $W_{FF}(z)$ to minimize the expected mean square error E ($e^2(n)$).

The feedback ANC subsystem 240 is configured to generate the anti-noise signal without using the reference microphone signal x(n) as an input, thereby avoiding many problems associated with feedforward wind noise suppression. The feedback ANC subsystem 240 predicts the ambient sound d(n) from the error signal e(n) and an estimate of the anti-noise signal y(n). An input signal x'(n), which is an estimate of the ambient sound d(n), is generated by combining the error signal e(n) and a filtered version of the estimated anti-noise signal, y'(n), through adder 250. The filter 248 models the secondary path $\hat{S}(z)$ (e.g., the electro-acoustic path between the digital filter 246 and the error microphone) to align the phase of the anti-noise signal y(n) with the error signal e(n). The input signal x'(n) is provided as an input to feedback digital filter 246 and filtered via filter 244 with a model of the secondary path ($\hat{S}(z)$) (to account for the delay in the electro-acoustic secondary path), for input to the feedback adaptation block 242. The feedback adaptation module 242 receives the error signal e(n) and the filtered estimated ambient sound x'(n) and updates the weights $W_{FB}(z)$ of filter 246 to minimize the expected mean square error (e.g., using a similar LMS update process as discussed above with reference to the feedforward ANC subsystem 210). In some embodiments, the digital filters 214 and 246 can be implemented as Infinite Impulse Response (IIR) or Finite Impulse Response (FIR) filters.

The ANC system 200 is further configured to suppress wind noise using both the feedforward ANC subsystem 210 and feedback ANC subsystem 240. In one embodiment, the anti-noise y(n) is the superposition (at an adder 260) of the feedforward digital filter 214 output and the feedback digital filter 246 output with gain factors of $G_1$ and $G_2$, respectively. In one embodiment, the gain factors are ranged between 0 and 1, with the sum of $G_1$ and $G_2$ equaling approximately 1.

The ANC system 200 further includes a wind detector 270 and a wind handler 272. The wind detector 270 receives the reference microphone signal x(n) as input and detects the presence of wind noise in the reference microphone signal. The wind handler 272 is triggered by an output of the wind detector 270 (e.g., an output flag indicating whether the wind noise has been detected or not) and controls feedforward ANC adaptation and feedback ANC adaptation (through feedforward adaptation module 212 and feedback adaptation module 242, respectively) and gain values $G_1$ and $G_2$. In some embodiments, the wind detector 270 outputs a detection state indicating detection of wind noise or absence of wind noise. The wind detector 270 may be implemented using a variety of techniques, for example, based on power spectrum methods and correlation methods as known in the art. Other wind noise detection components and processes may be used that can detect the presence or absence of wind noise in an input signal and producing an output indicating at least two states: (i) wind noise detected and (ii) wind noise not detected.

In some embodiments, wind noise detection may be performed according to the wind noise detection systems and methods disclosed in co-pending U.S. application Ser. No. 16/399,961, titled "WIND NOISE DETECTION SYSTEM AND METHODS," which is filed concurrently herewith and is incorporated by reference herein in its entirety. For example, a wind noise detector may be configured to receive a plurality of audio input signals from a plurality of reference microphones and output a plurality of wind noise detection flags including a single channel wind noise detection flag and a cross-channel wind noise detection flag, each wind noise detection flag indicating a presence or absence of wind noise, and a fusion smoothing module configured to receive the plurality of wind noise detection flags and generate an output wind noise detection flag. The wind handler configures the ANC system to generate an anti-noise signal in accordance with the output wind noise detection flag as disclosed herein.

In various embodiments, the wind noise detector includes a single channel detector operable to receive a single audio channel and generate a single channel wind noise detection flag. The single channel detector may be operable to compare the single audio channel with a wind spectrum model that comprises a mean and a standard deviation of a power ratio of a portion of frequency components and a spectrum slope. The wind noise detector may be configured to clear a flag if the mean of the power ratio is less than a threshold mean and the standard deviation is greater than a threshold standard deviation (e.g., when wind noise is determined to be absent) and set a flag if the spectrum slope is greater than a predetermined threshold spectrum slope (e.g., when wind noise is determined to be present). The wind noise detector may further include a cross-channel detector operable to compute auto correlations and a cross correlation between two or more audio channels and, for example, set a flag if the auto correlations are less than the cross correlation.

The wind handler 272 is configured to control the ANC system 200 in response to the wind detector 270 outputs. For example, the wind handler 272 may be configured to selectively activate/deactivate the feedforward ANC subsystem 210 and the feedback ANC subsystem 240. When wind noise is detected, for example, the wind handler 272 may freeze the feedforward adaptation (e.g., via feedforward adaptation module 212) and enable the adaptation of the feedback ANC subsystem 240 (e.g., through feedback adaptation module 242) to generate the anti-noise y(n). In this state, the gain value $G_1$ is set to zero (no gain) and gain value $G_2$ is set to one. When wind noise is not detected, the wind handler 272 may freeze the feedback adaptation (e.g., via feedback adaption module 242) and enable the adaptation of the feedforward ANC subsystem 210 (e.g., through feedback adaptation module 242) to generate the anti-noise. In this state, the gain value $G_2$ is set to zero and gain value $G_1$ is set to one.

In accordance with one or more embodiments, the wind detector 270 is configured to set a wind noise detection flag to indicate whether wind noise has been detected, and the wind handler 272 is operable to configure the ANC system 200 in response to changes in the wind noise detection flag. If the wind noise detection flag changes from a wind noise absent to wind noise detected state, the wind handler 272 freezes the feedforward adaptation module 212 and changes $G_1$ from 1 to 0 and $G_2$ from 0 to 1 to transition the anti-noise signal from the feedforward ANC subsystem 210 to the feedback ANC subsystem 240. The feedback adaptation module 242 is activated to adaptively remove the wind noise in response to the error signal e(n) Different fading functions may be used to increase/decrease the gain values of $G_1$ and $G_2$ during the transition to limit unwanted audio artefacts (e.g., to avoid/reduce audible clicks and pops). In various embodiments, the fading functions may include linear, exponential, sine, and logarithm functions and may be implemented in sample based or frame-based approaches.

When the wind detector 270 changes the wind noise detection flag from wind noise detected to wind noise absent, the wind handler 272 freezes the feedback adaptation module 242, changes $G_2$ from 1 to 0 and $G_1$ from 0 to 1 to transition the anti-noise signal from the feedback ANC subsystem 240 to the feedforward ANC subsystem 210. One or more fading functions may be used to gradually increase/decrease the gain value $G_1$ and the gain value $G_2$ to smooth the transition and limit unwanted audio artefacts. The feedforward adaptation module 212 is activated to adaptively generate the anti-noise signal in response to the reference microphone signal x(n) and the error signal e(n).

Figure 3:
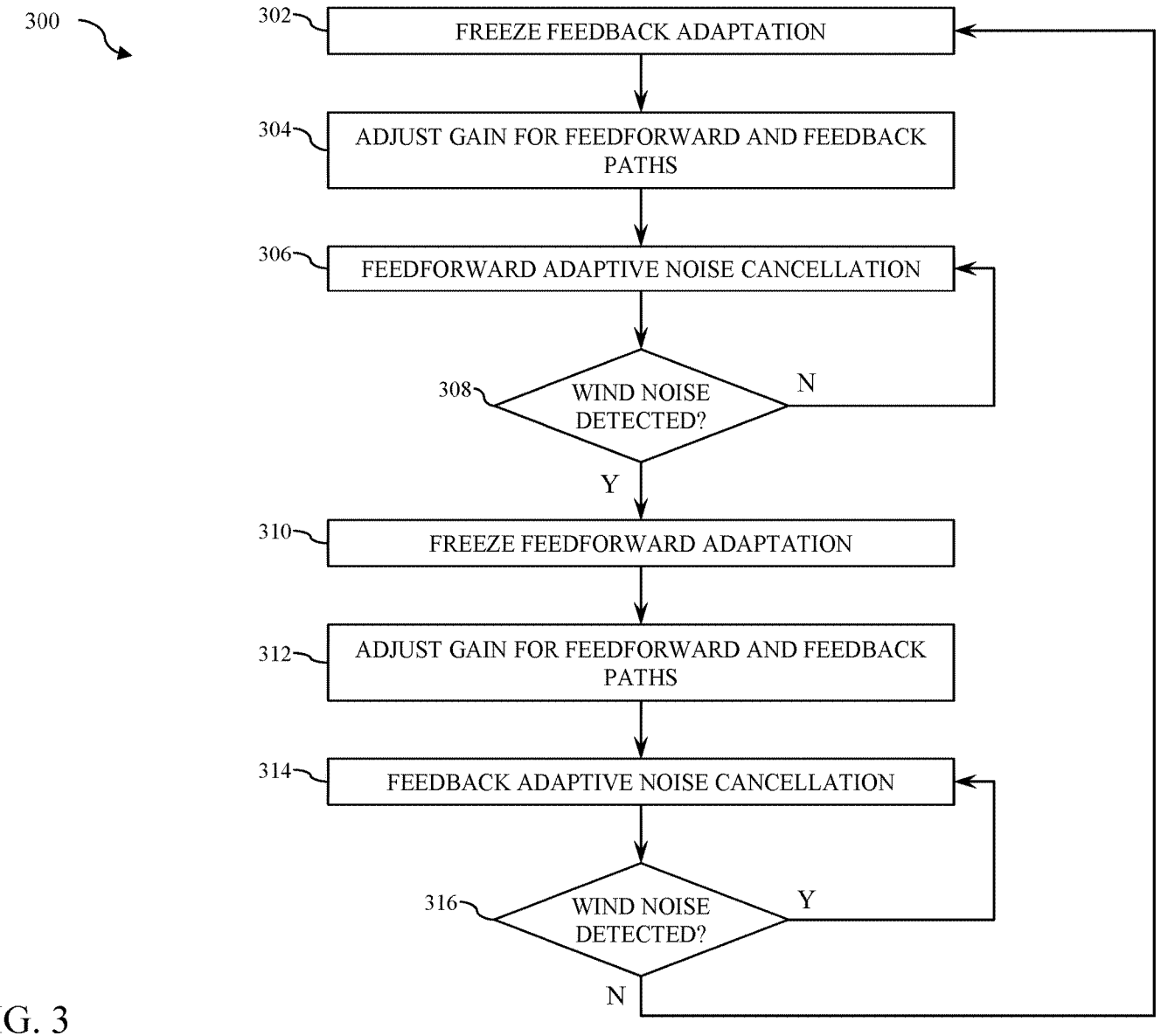
FIG. 3 illustrates a process for detecting and handling wind noise in an active noise cancellation system, in accordance with one or more embodiments of the present disclosure.

An embodiment of an operation of the active noise cancellation system 200 of FIG. 2 will now be described with reference to the process 300 of FIG. 3. The process 300 starts operation using a feedforward ANC subsystem. In step 302, feedback adaptation is frozen, and gain is adjusted for the feedforward path and the feedback paths in step 304 to pass the anti-noise received from the feedforward ANC subsystem to a loudspeaker for noise cancellation. In step 306, the feedforward adaptive noise cancellation is performed to cancel sensed ambient noise.

A wind detector monitors the reference signal to detect wind noise. In step 308, if wind noise has not been detected, the ANC system continues with the feedforward adaptive noise cancellation processing. If wind noise is detected, processing proceeds to step 310 to transition the ANC system to use the feedback ANC subsystem to generate the anti-noise signal until wind noise is no longer detected. In step 310, the feedforward adaptation process is frozen. In step 312, the gain values for the feedforward and feedback paths are adjusted to pass the anti-noise signal generated by the feedback ANC subsystem to a loudspeaker for noise cancellation. In step 314, feedback adaptation is performed to adaptively generate the anti-noise signal. The process continues until wind noise is no longer detected (step 316), then processing continues in step 302 to transition back to a feedforward ANC processing mode.

In another embodiment, the feedback noise cancellation subsystem of the active noise cancellation system 200 of FIG. 2 is kept "on" during operation. The wind handler 272 is configured to turn "on" and "off" the feedforward noise cancellation subsystem in accordance with the results from wind detector 270. When wind noise is detected, the feedforward path is turned "off" and the anti-noise signal is generated from the output of the feedback path. When wind noise is not detected, the feedforward path is turned "on" and the anti-noise signal is generated as the superposition of the output from the feedforward path and the output from the feedback path.

Figure 4:
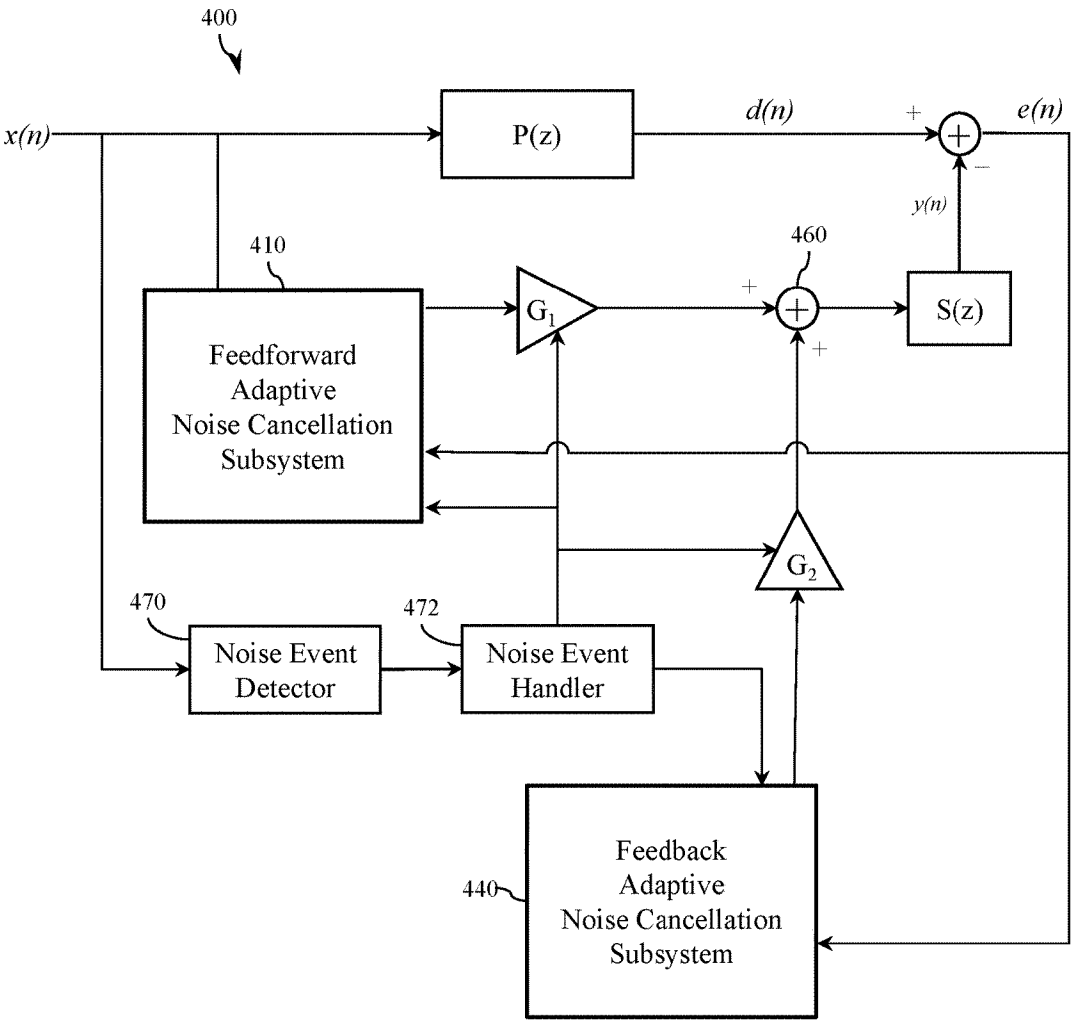
FIG. 4 illustrates an active noise cancellation system including noise event detection and handling components, in accordance with one or more embodiments of the present disclosure.

The systems and methods disclosed herein can be implemented in various audio devices, such as headphone, headset, cell phone, smart phone, tablet, and hearing aids. Embodiments can be applied to both adaptive and fixed ANCs. In some embodiments, the teachings of the present disclosure can be applied to other sources of local reference microphone noise, such as noise caused by a temporary reference microphone malfunction. For example, as illustrated in FIG. 4, an active noise cancellation system 400 includes a noise event detector module 470 and a noise event handler module 472 to transition between a feedforward adaptive noise cancellation subsystem 410 and a feedback adaptive noise cancellation subsystem 440, based on a status of a detected event. In some embodiments, the noise event may include detecting noise events that are not correlated with ambient noise conditions. In operation, the anti-noise signals generated by each subsystem are gain adjusted by gain values $G_1$ and $G_2$ and joined at adder component 460.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. An active noise cancellation system comprising:

a reference sensor configured to generate a reference signal from external noise;

an error sensor configured to generate an error signal from sound sensed in a noise cancellation zone;

a feedforward noise cancellation subsystem configured to generate a first anti-noise signal using the reference signal and the error signal;

a feedback noise cancellation subsystem configured to generate a second anti-noise signal using the error signal;

a wind detection module configured to determine whether wind noise is present in the reference signal, and output a wind noise detection status; and a wind handler module configured to control the feedforward noise cancellation subsystem and the feedback noise cancellation subsystem in accordance with the wind noise detection status and to generate an output anti-noise signal using the first anti-noise signal and the second anti-noise signal;

wherein the wind handler module is configured to disable adaptive feedback noise cancellation if wind noise is not present.

2. The active noise cancellation system of claim 1 wherein the wind handler module is configured to disable adaptive feedforward noise cancellation in response to detected wind.

3. The active noise cancellation system of claim 1 wherein the wind detection module is configured to detect wind noise that is not correlated with ambient noise received in the noise cancellation zone.

4. The active noise cancellation system of claim 1, further comprising a processor and a memory storing program instructions for execution by the processor, and wherein the wind handler module comprises program instructions stored in the memory.

5. The active noise cancellation system of claim 1 further comprising an adder configured to combine the first anti-noise signal and the second anti-noise signal to generate the output anti-noise signal.

6. The active noise cancellation system of claim 1, wherein the active noise cancellation system comprises an active noise cancelling headphone, earbud or hearing aid.

7. The active noise cancellation system of claim 1, further comprising a first variable gain module configured to adjust a first gain of the first anti-noise signal, and a second variable gain module configured to adjust a second gain of the second anti-noise signal, and wherein the wind handler module is configured to set the first gain and the second gain in response to the wind noise detection status.

8. The active noise cancellation system of claim 7 wherein the output anti-noise signal includes a first gain adjusted first anti-noise signal and a second gain adjusted second anti-noise signal.

9. An active noise cancellation system comprising:

a reference sensor configured to generate a reference signal from external noise;

an error sensor configured to generate an error signal from sound sensed in a noise cancellation zone;

a feedforward noise cancellation subsystem configured to generate a first anti-noise signal using the reference signal and the error signal;

a feedback noise cancellation subsystem configured to generate a second anti-noise signal using the error signal;

a wind detection module configured to determine whether wind noise is present in the reference signal, and output a wind noise detection status;

a wind handler module configured to control the feedforward noise cancellation subsystem and the feedback noise cancellation subsystem in accordance with the wind noise detection status and to generate an output anti-noise signal using the first anti-noise signal and the second anti-noise signal; and a first variable gain module configured to adjust a first gain of the first anti-noise signal, and a second variable gain module configured to adjust a second gain of the second anti-noise signal, and wherein the wind handler module is configured to set the first gain and the second gain in response to the wind noise detection status.

10. The active noise cancellation system of claim 9 wherein the output anti-noise signal includes a first gain adjusted first anti-noise signal and a second gain adjusted second anti-noise signal.

11. The active noise cancellation system of claim 10 wherein the wind handler is further configured to transition between feedback adaptive noise cancellation and feedforward adaptive noise cancellation in response to a change in the wind noise detection status.

12. A method comprising:

generating a reference signal from external noise;

generating an error signal from noise sensed in a noise cancellation zone;

generating, using a feedforward noise cancellation process, a first anti-noise signal using the reference signal and the error signal;

generating, using a feedback noise cancellation process, a second anti-noise signal using the error signal;

determining whether wind noise is present in the reference signal and setting a corresponding wind noise detection status;

controlling adaptation processing in the feedforward noise cancellation process and the feedback noise cancellation process in accordance with the wind noise detection status and mixing of the first anti-noise signal and the second anti-noise signal to generate an output anti-noise signal; and disabling adaptive feedback noise cancellation if wind noise is absent.

13. The method of claim 12 further comprising adjusting a first gain of the first anti-noise signal a second gain of the second anti-noise signal in response to the wind noise detection status.

14. The method of claim 13 further comprising, after adjusting the first gain of the first anti-noise signal and the second gain of the second anti-noise signal, generating the output anti-noise signal by combining the first anti-noise signal and the second anti-noise signal.

15. The method of claim 14 further comprising detecting changes in the wind noise detection status and transitioning between a feedback adaptive noise cancellation process and a feedforward adaptive noise cancellation process.

16. The method of claim 12 further comprising disabling adaptive feedforward noise cancellation if wind noise is detected.

17. The method of claim 12 wherein the wind noise is not correlated with ambient noise received in the noise cancellation zone.

18. The method of claim 12, wherein controlling adaptation processing of the feedforward noise cancellation process is performed by a wind handler module of a digital signal processor.

19. The method of claim 12 further comprising combining the first anti-noise signal and the second anti-noise signal to generate the output anti-noise signal.

20. The method of claim 12, wherein the method is performed in an active noise cancelling headphone, earbud or hearing aid.

* * * * *